US008800886B2

(12) United States Patent
Murdock, Jr. et al.

(10) Patent No.: US 8,800,886 B2
(45) Date of Patent: Aug. 12, 2014

(54) SAFETY LOCK FOR A ROTATABLE SPRAY NOZZLE OF A SPRAY DEVICE

(76) Inventors: Rick Murdock, Jr., Atwater, OH (US); Rick Murdock, Sr., Atwater, OH (US)

( * ) Notice: Subject to any disclaimer, the term of this patent is extended or adjusted under 35 U.S.C. 154(b) by 554 days.

(21) Appl. No.: 12/932,612

(22) Filed: Mar. 1, 2011

(65) Prior Publication Data

US 2012/0223155 A1 Sep. 6, 2012

(51) Int. Cl.

| | |
|---|---|
| ***B05B 15/02*** | (2006.01) |
| ***F23D 11/34*** | (2006.01) |
| ***B05B 1/28*** | (2006.01) |
| ***B05B 15/04*** | (2006.01) |

(52) U.S. Cl.
USPC ..... 239/119; 239/288; 239/288.3; 239/288.5; 239/DIG. 22

(58) Field of Classification Search
USPC ..... 239/119, 288.3, 288.5, DIG. 22, 288; 215/216, 217, 289, 277
See application file for complete search history.

(56) References Cited

U.S. PATENT DOCUMENTS

| | | | | |
|---|---|---|---|---|
| 3,729,848 | A * | 5/1973 | Wilhelm et al. | 42/13 |
| 3,952,955 | A | 4/1976 | Clements | |
| 4,165,836 | A | 8/1979 | Eull | |
| 5,280,853 | A * | 1/1994 | Perret, Jr. | 239/119 |
| 5,285,965 | A | 2/1994 | McCutcheon et al. | |
| 5,749,528 | A | 5/1998 | Carey et al. | |
| 5,893,522 | A * | 4/1999 | Kieffer | 239/600 |
| 5,947,381 | A * | 9/1999 | Carey | 239/119 |
| 6,390,386 | B2 | 5/2002 | Krohn et al. | |
| 6,481,640 | B1 | 11/2002 | Carey et al. | |
| 6,502,763 | B1 * | 1/2003 | McCann | 239/119 |
| 6,655,606 | B2 * | 12/2003 | Earl | 239/104 |

* cited by examiner

*Primary Examiner* — Ryan Reis
(74) *Attorney, Agent, or Firm* — Hudak, Shunk & Farine Co. LPA

(57) ABSTRACT

A safety lock for a spray nozzle assembly for an airless, high pressure spray device, and more particularly to safety locks or guards for reversible, rotatable spray nozzles assemblies, optionally provided with a tip guard.

20 Claims, 2 Drawing Sheets

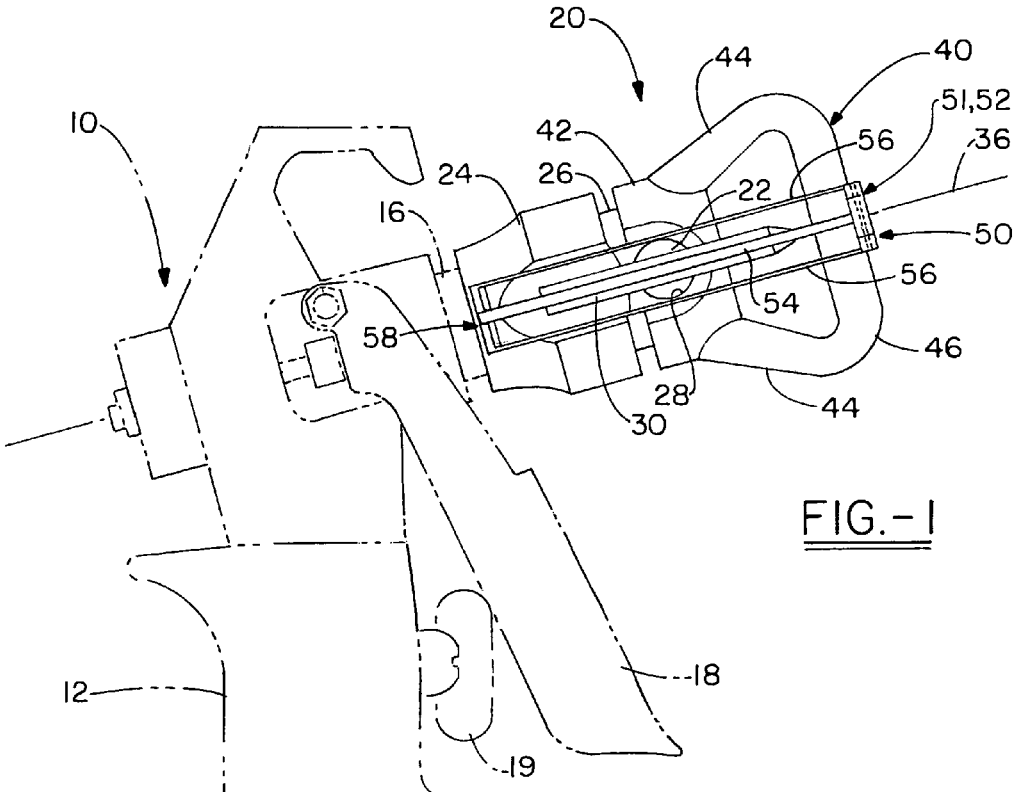
FIG.-1
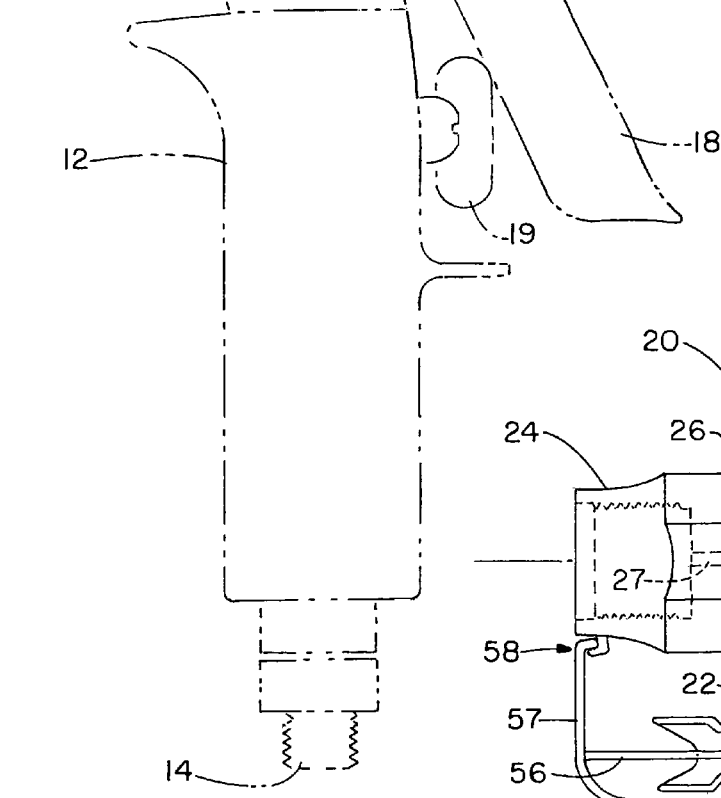
FIG.-2
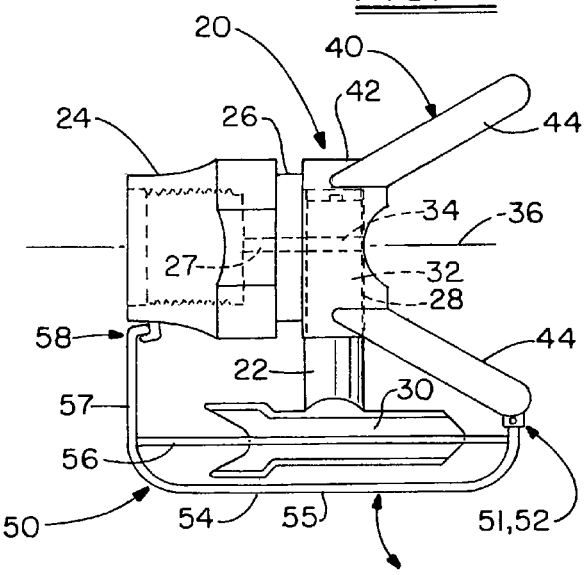

SAFETY LOCK FOR A ROTATABLE SPRAY NOZZLE OF A SPRAY DEVICE

FIELD OF THE INVENTION

The present invention relates to a safety lock for a spray nozzle assembly for an airless, high pressure spray device, and more particularly to safety locks or guards for reversible, rotatable spray nozzle assemblies, optionally provided with a tip guard.

BACKGROUND OF THE INVENTION

Reversible, rotatable spray nozzle assemblies are widely used by spray devices, such as for high pressure, airless spraying of paint and other fluids. In a typical reversible spray nozzle assembly, a small spray nozzle, bore or tip is carried in a cylindrical, rotatable nozzle shaft. The nozzle shaft can be rotated 180 degrees, thereby reversing the direction of paint flow through the nozzle, bore or tip for cleaning nozzle obstructions. Typically the spray nozzles or tips are interchangeable with other spray nozzles carrying nozzles of various diameters and capacities.

Reversible spray nozzles or tips are generally utilized in hydraulic or airless spray painting or coating, wherein paint under high pressure is supplied to a spray gun and forced through a spray tip or nozzle, to aid in cleaning clogs that may form at the nozzle. Clogs can form due to the nature of the spray devices, wherein it is necessary for the spray opening in the spray nozzle be very small so that as the paint reaches the spray tip under high pressure and low velocity, it is accelerated through the spray opening at a high velocity and low pressure thereby forming a spray suitable for painting. Owing to the small size of the spray opening, the spray nozzle is susceptible to clogging. By providing a reversible tip, the spray nozzle can be turned generally 180 degrees and the paint or particles causing the clog can be discharged.

When using reversible spray nozzles or tips, user safety must be the most important concern. The spray that emanates from the nozzle of the spray device has the highest velocity and narrowest stream, and provides a risk of injury to the user. In view of this situation, prior spray devices have included various styles of spray guards to prevent the user's body from being hit by the spray jet near the spray nozzle orifice.

An additional problem spawning from the use of the reversible spray nozzle or tip is that it is possible to rotate the spray nozzle out of position, especially if the nozzle handle is bumped or jarred in the course of handling or moving the spray device. It is also possible for a user to fail to properly align and rotate the nozzle completely into the correct position before activating the spray devices. These circumstances can yield a condition, wherein the nozzle is not properly aligned when fluid flow is activated, that can result in accidents that can range in severity from nuisances such as erratic paint disbursement to injuries from skin or eye irritation, blindness, trip and falls, to possibly death.

U.S. Pat. No. 6,481,640 to Carey et al. relates to a saddle seal and washer insertion tool for airless paint spray tip assemblies having a housing containing a reversible tip holder of the type having cylindrical barrel with a handle formed of a polymer, located on and positioned generally transversely of the barrel, the housing having a longitudinal through bore for permitting delivery of paint, and a transverse bore for receiving the barrel of the tip holder, the insertion tool formed integrally with an end of the handle, the tool having a first portion with a width conforming to an internal diameter of the washer and a second portion extending beyond the first portion with a width conforming to a diameter of a bore in the saddle seal such that the washer can be received on the first portion and the saddle seal received on the second portion for alignment and installation into the housing.

U.S. Pat. No. 6,390,386 to Krohn et al. relates to a reversible airless spray tip. A positioning detent on the spray tip carrier handle snaps positively into place when a nozzle carrier is rotated into spray position, indicating that the tip is properly positioned for spraying. A piston seal has a slot-like fluid passage, which is preferably substantially rectangular in cross section. A rearward end of the piston seal is sealed by a resilient ring compressed directly against the face of an attached spray gun. A tip retainer is expanded by swaging after insertion, which forces a lip into a mating slot. The tip retainer also has an expanded chamber which diffuses reverse fluid flow for safety.

U.S. Pat. No. 5,749,528 to Carey et al. relates to a reversible spray tip or nozzle used with a spray gun or like device for hydraulically atomizing and spraying liquids such as paint. The spray tip includes a plastic housing having a forward extending spray tip guard integral therewith, a cylindrically shaped rotatable turret member diametrically received for rotation in the housing and having a diametric bore therethrough for receipt of a spray tip insert, and an elongated seal insert axially received in the housing upstream from the turret member. A securing nut rotatably mounted to the housing at the spray gun end thereof secures the reversible spray tip to the discharge end of the spray gun. The enhanced sealing effectiveness of the reversible spray tip permits effective sealing of the assembly by finger tightening of the securing nut.

U.S. Pat. No. 5,285,965 to McCutcheon et al. relates to a tip guard is provided to reportedly protect a user of an air-assisted airless paint spray gun from injury. The tip guard has a base having a shoulder and an aperture adapted for engagement to the air cap and tip of an air-assisted airless paint spray gun. The base further has a pair of transition portions extending axially forward from said aperture, where notches formed in the transition portions are adapted to engage the forwardly-extending horns of the air cap of an air-assisted airless paint spray gun. Each transition portion further has a pair of vanes extending forwardly and radially outwardly from the transition portion, where each of said pair of vanes is then joined by a crossbar.

U.S. Pat. No. 4,165,836 to Eull relates to an apparatus for attachment to a hand operated spray gun, comprising a cylindrical rotatable member having a spray orifice therein, which is rotatable between a spraying position and an orifice cleaning position, the rotatable cylindrical member having a metallic sealing member surface of matching shape and adjacent thereto, and a further resilient sealing member for permitting leakproof attachment to a spray device. The rotatable spray member is actually coupled to a safety tip guard so as to become disassembled if the safety tip guard is removed.

U.S. Pat. No. 3,952,955 to Clements relates to an apparatus for fitting over the spray tip end of an airless paint spray gun, wherein the apparatus comprises a pair of forwardly projecting ears and a narrow slotted region opening said spray tip, and is adapted for key alignment with the spray tip.

Even through some prior art devices include features such as rotation stops or limits, such devices can be subject to user error and do not solve the problem of transverse misalignment in a direction perpendicular to the axial spray flow direction through the nozzle or tip.

SUMMARY OF THE INVENTION

In view of the above, it would be desirable to provide such spray devices with a safety feature to prevent misalignment of the spray nozzle or tip both in the axial direction of spray flow and in a direction perpendicular to the axial spray flow direction.

It is an object of the present invention to provide a spray device having a rotatable spray nozzle or tip with a safety lock connectable thereto that protects the spray nozzle and prevents the same from moving out of spraying alignment.

A further object of the present invention is to provide a safety lock that is connected to a portion of the spray device other than the spray nozzle and is movable into and out of engagement with the spray nozzle in order to lock the spray nozzle in a spraying position.

Yet another object of the present invention is to provide a safety lock connected to one or more of a spray guard, a body of the spray device or a portion of a spray nozzle assembly and movable to lock the position of the spray nozzle.

An additional object of the present invention is to provide a safety lock that surrounds the handle of the spray nozzle and prevents the spray nozzle from being misaligned.

An additional object of the present invention is to provide a safety lock having a contour closely fitted to the exterior dimensions of the handle and fits thereover in order to provide a physical stop to prevent the handle from rotating as well as visual notice to a user that the handle is constrained and in a safe position for applying a coating.

In one aspect of the present invention spray device is disclosed comprising a rotatable, reversible spray tip, the spray tip having a handle for rotating the spray tip relative to a body of the spray device, a safety lock operatively connected to a) the body of spray device, b) a safety guard of the spray device, or c) a portion of a spray tip assembly of the spray device, the safety lock having a cover substantially conforming to the shape of the handle such that the cover is selectively engagable with the handle to prevent the handle from rotating out of a spraying position.

Another aspect of the present invention discloses a spray nozzle assembly with a safety lock for a spray device, comprising a base connectable to the spray device, the base having an orifice to allow a coating to pass through the base, the base having a bore extending substantially transverse to the orifice, a spray tip having a shaft located in the base bore and rotatable therein, the spray tip shaft having a bore to allow a coating to pass therethrough when aligned with the base orifice, the spray tip having a handle, and a safety lock having a connector attached to a portion of the spray nozzle assembly, the safety lock having a cover that is engagable with the handle in a locked position that prevents the handle from being rotated such that the shaft bore is out of alignment with the base orifice.

BRIEF DESCRIPTION OF THE DRAWINGS

The invention will be better understood and other features and advantages will become apparent by reading the detailed description of the invention, taken together with the drawings, wherein:

FIG. 1 is a side elevational view of one embodiment of a safety lock of the present invention connected to a spray guard affixed to one embodiment of a spray device;

FIG. 2 is a top plan view of a portion of the spray device, spray guard and safety lock illustrated in FIG. 1;

DETAILED DESCRIPTION OF THE INVENTION

Figure 3:
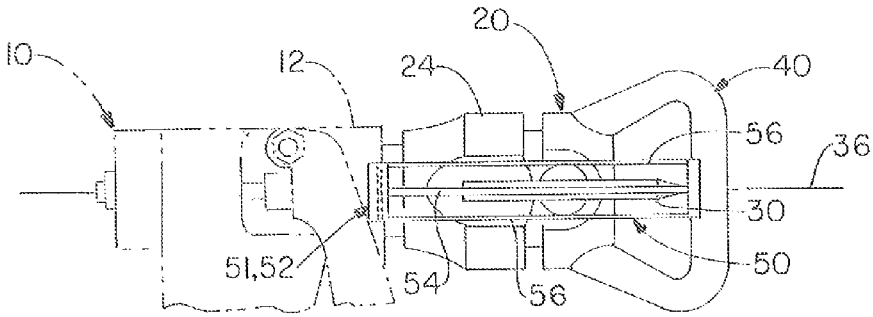
FIG. 3 is a side elevational view of a further embodiment of a safety lock of the present invention connected to a portion of a spray nozzle assembly.

This description of preferred embodiments is to be read in connection with the accompanying drawings, which are part of the entire written description of this invention. In the description, corresponding reference numbers are used throughout to identify the same or functionally similar elements. Relative terms such as "horizontal", "vertical", "up", "down", "top" and "bottom" as well as derivatives thereof (e.g., "horizontally", "downwardly", "upwardly", etc.) should be construed to refer to the orientation as then described or as shown in the drawing figure under discussion. These relative terms are for convenience of description and are not intended to require a particular orientation unless specifically stated as such. Terms including "inwardly" versus "outwardly", "longitudinal" versus "lateral" and the like are to be interpreted relative to one another or relative to an axis of elongation, or an axis or center of rotation or a portion of the device, as appropriate. Terms concerning attachments, couplings and the like, such as "connected" and "interconnected", refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, FIG. 1 illustrates one embodiment of a spray device 10 having a spray nozzle assembly 20 connected thereto, the assembly 20 including a rotatable spray nozzle or tip 22 and a safety lock 50 mated to the spray nozzle or tip 22 that prevents the spray nozzle or tip 22 from becoming misaligned out of a spraying or cleaning position.

The spray device 10 can be of any construction and is preferably an airless high pressure sprayer that provides a relatively high velocity stream or jet of a coating material, for example paint for use in painting or coating materials or objects, e.g. walls, ceilings, substrates, etc. The spray device has frame 12 that has a coating inlet port 14 and an outlet port 16 preferably having a threaded outer surface for connection to the spray nozzle assembly 20. A trigger assembly 18 controls the flow of the coating through the outlet port 16. Suitable spray devices are available from Graco of Minneapolis, Minn., and Titan Tool of Plymouth, Minn. The spray device 10 may be equipped with a safety device, such as but not limited to a trigger lock 19 to prevent accidental discharge of the coating from the outlet port 16.

The spray nozzle assembly 20 in one embodiment includes an internally threaded retaining nut 24 optionally including a gripping surface such as a scalloped and/or angled exterior that allows a user to hand mount and/or tool mount the spray nozzle assembly 20 on the spray device 10, generally at the outlet port 16. One end of a base 26 of the spray nozzle assembly 20 is operatively connected to retaining nut 24 and another end is operatively connected to the spray guard 40. A cylindrical spray nozzle or tip 22 is slidably and rotatably located in transverse bore 28 of the base 26. The spray tip 22 can be rotated into a spray position as illustrated or in a reversed cleaning position generally 180° rotated from the position shown, by turning the attached handle 30.

Base 26 generally includes a longitudinal bore, a fluid passage 27 that is substantially perpendicular to the transverse bore 28 which it intersects. The longitudinal bore or fluid passage 27 preferably has or is fitted with base seal, with the seal having a generally concave sealing surface that mates with the cylindrical contour of the shaft 32 of the spray tip 22. Base 26 may be provided with or contain a seal at the rearward end of the base that can be compressed between the end of the base 26 and the outlet port 16 of the spray device 10 to prevent leakage with the seal obviously including a bore therethrough allowing for passage of the coating fluid.

Fluid passage 27, having any desired cross section such as a rectangular cross-section or circular cross-section, extends longitudinally through the base 26. When the rotatable spray tip 22 is rotated into the spraying position or the cleaning position, the shaft bore 34 aligns axially with the fluid passage 27 along longitudinal axis 36. As pressurized fluid is supplied from the spray device 10, the fluid or coating is allowed to flow through outlet port 16 of spray device 10 then through spray nozzle assembly 20 via fluid passage 27 and base 26 and further through shaft bore 34 of spray tip 22, and emerges in a spray pattern along longitudinal axis 36.

As known in the art, the shaft 32 of the spray tip 22 slidably passes through an opening in the base 26 of the spray nozzle assembly 20 to insert into the transverse bore 28 of base 26. Handle 30 of spray tip 22 is connected to shaft 32 in any suitable manner. Shaft 32 co-rotates with handle 30. The handle enables the user to rotate the shaft 32 between the spray position and a reverse flow, cleaning position, as well as any position therebetween.

Spray guard 40 includes a body 42 and one or more support arms 44, preferably four support arms 44 extending outwardly and forwardly from spray guard body 42. Two or more arms 44 may be connected by a tip guard 46 which can be in the form of an aerodynamic air foil, if desired. The spray guard 40 helps to prevent objects, especially a user's hand or other portion of the user's body from coming into contact with the relatively high velocity spray jet near the nozzle assembly 20, generally where the jet velocity is highest and the stream most narrow. The spray guard 40 generally serves as a warning and establishes a safe boundary for the user.

While the spray tip may be provided with a stop such as a locking cam element, see for example U.S. Pat. No. 5,749,528 herein incorporated by reference, in an effort to prevent rotation of the spray nozzle shaft 32 out of alignment, such features are not always reliable. For example when a user sets the spray device 10 down or bumps an object with the spray device 10, the shaft 32 can rotate and the shaft bore 39 can become misaligned with the longitudinal axis 36 and the base bore 28 of the spray nozzle assembly 20. If the user does not realize the misalignment and activates the trigger mechanism 18 of the spray device, the coating can spray out between the shaft 32 and the base 28 of the spray nozzle assembly 20 and cause the user to be injured by the spray and/or damage to the surrounding area.

In order to solve this problem and prevent accidental misalignment, the spray device 10, and more preferably the spray tip assembly 20 is provided with safety lock 50 that prevents the spray tip 22, and particularly the handle 30 thereof from being rotated out of spraying alignment.

The safety lock 50 is a formed housing having a cover 54 that closely conforms to and generally fits over in some embodiments, the handle 30 of the rotatable spray tip 22. In one embodiment, the cover preferably includes at least one side 56, see FIG. 2 having a longitudinal length extending along a distance, preferably the entire distance, of the longitudinal length of the handle 30 that prevents the handle 30 from being rotated out of alignment with the longitudinal axis of the spray nozzle assembly 20. In additional embodiments, the safety lock 50 is provided with a top 55 wherein when the safety lock 50 is in a connected position contacts a top side or outer end of the handle and prevents the spray tip 22 and handle 30 thereof from being dislodged or backed out of bore 28 whereby the shaft bore 34 would be misaligned with the fluid passage 27 of base 26. In a preferred embodiment both the top 55 and side 56 are provided on safety lock 50, thereby forming a cover, shield or protective guard around the outer surface of handle 30. In some embodiments, the one or more sides 56 and top 55 of safety lock 50 are integrally formed and can be in the form of a cap or the like.

Safety lock 50 includes a base 51 that is connected to one or more of a portion of the spray nozzle or tip assembly 20 and the spray device 10. FIGS. 1 and 2 illustrate the base 51 connected to the spray guard 40, namely the tip guard 46 of spray tip assembly 20. FIG. 3 illustrates safety lock 50 having base 51 connected to the frame 12 of the spray device 10. Base 51 is connected to the spray device or spray tip assembly in any suitable manner such as by fastening, gluing, welding, etc. In one embodiment the base 51 is connected to the housing by a hinge system that allows the safety lock cover 54 to be moved out of the way, to an "unlocked" position, to allow adjustment of the spray tip 22.

Base 51 includes a connector 52 that allows the cover to be movable in relation to the portion of the base connected to the spray nozzle assembly 20 or spray device 10. Preferably the connector 52 is in the form of a hinge or pivot. When the safety lock is formed out of a polymer, in one embodiment the connector 52 can be a living hinge. Connector 52 allows the cover 54 to be moved into a locked position and an unlocked position, for example as illustrated utilizing dashed lines in FIG. 2 whereby the handle 30 is allowed to be rotated by the user.

In a preferred embodiment, the safety lock 50 is provided with a locking mechanism or lock system 58, such as illustrated in FIG. 2 that maintains the cover 54 in a position secured to the spray device 10 or spray nozzle or tip assembly 20 such that the handle 30 of the spray tip 22 cannot be rotated or misaligned. Lock system 58 in one embodiment includes a projection and/or detent. For example as illustrated in FIG. 2, the end 57 of safety lock 50 includes a projection that mates with a recess of the locking segment connected to the base 26 of the spray tip assembly 20.

The safety lock 50 prevents the need of visual notice to the user that the handle 30 is in its desired position and also prevents the handle 30 from being dislodged accidentally by the user. Safety lock 50 can be formed of any suitable material, such as one or more of a polymer, metal, or the like.

Figure 4:
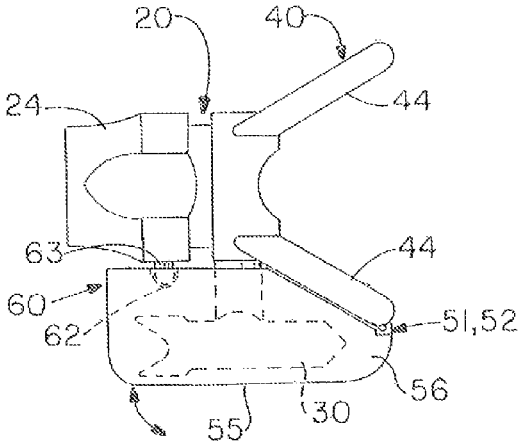
FIG. 4 is a top view of a portion of the spray device, illustrating a further embodiment of a safety guard and safety lock.

FIG. 4 illustrates a further embodiment of the safety lock 50 of the present invention including a base 51 having a connector 52 connected to the spray nozzle assembly 20, namely the spray guard 40. The safety lock 50 includes a snap fit connection 60 that releasably fastens the cover 54 to the spray device 10 to prevent movement of the rotable spray tip 22. The snap fit connection generally includes an indent or recess 62 which matable receives a projection 63.

Figure 5:
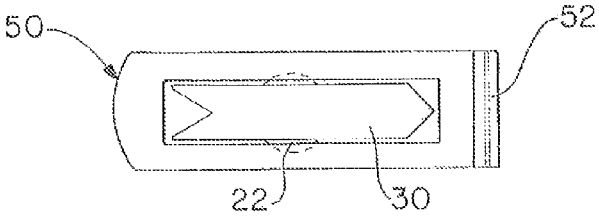
FIG. 5 is a side elevational view of 2 a further embodiment of a safety lock of the present invention form-fitted to a shape of a handle of the spray nozzle.

FIG. 5 illustrates a portion of the safety lock 50 having a body that closely conforms to a portion of the outline or shape of the rotable spray tip 22, specifically handle 30 thereof.

Figure 6:
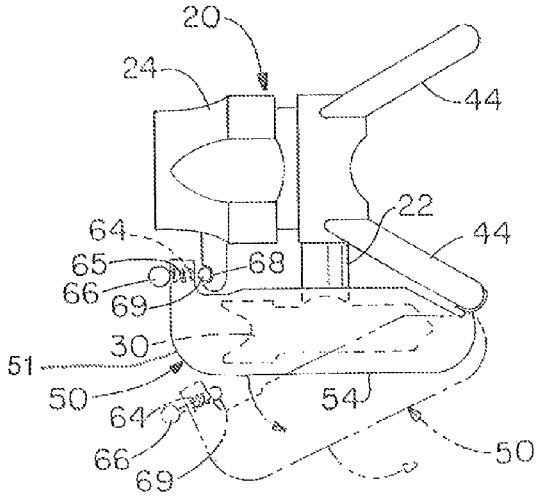
FIG. 6 is a top view of a further embodiment of a safety lock of the present invention including a spring-biased pin releasably accommodated in a recess of the spray nozzle assembly.

FIG. 6 illustrates a further embodiment connecting a safety lock 50 to a portion of the spray device 10, namely spray guard 40. A first end of the safety lock 50 is connected to arm 44 of spray guard 40 by a connector 52, generally in the form of a hinge. Safety lock 50 also includes a lock system 58 including a knob 66 connected to a shaft 65 extending through a portion of the body of the safety lock 50 that has a pin 69 located at a second end of the shaft. A spring 64 biases the pin in a direction such that it can be fixed in recess 68 connected to a portion of the spray guard 40. When the safety lock body is moved into a locked position preventing movement of the handle 30, the pin is affixed in recess 68. Knob 66 can be utilized to release the pin from the recess 68.

While in accordance with the patent statutes, the best mode and preferred embodiment have been set forth, the scope of the invention is not limited thereto, but rather by the scope of the attached claims.

What is claimed is:

1. A spray device, comprising:

a rotatable, reversible spray tip, the spray tip having a handle for rotating the spray tip relative to a body of the spray device;

a safety lock operatively connected to a) the body of spray device, b) a safety guard of the spray device, or c) a portion of a spray tip assembly of the spray device, the safety lock having a cover substantially conforming to the shape of the handle such that the cover is selectively engagable with the handle to prevent the handle from rotating out of a spraying position; and wherein the safety lock is hingedly connected to the spray device and allows the cover to be moved into a locked position and an unlocked position with respect to the handle.

2. The spray device according to claim 1, wherein the cover includes at least one side having a longitudinal length extending a distance along a longitudinal length of the handle that prevents the handle from being rotated out of alignment with a longitudinal axis of the spray tip assembly in the spraying position.

3. The spray device according to claim 2, wherein the at least one side extends the entire distance of the longitudinal length of the handle.

4. The spray device according to claim 1, wherein the safety lock in a locked position includes a top that contacts a top side of the handle and prevents the spay tip from being misaligned with a fluid passage of the spray device.

5. The spray device according to claim 1, wherein the safety lock has a base that is connected to the safety guard by a hinge connector, gluing or welding.

6. The spray device according to claim 1, wherein the safety lock is provided with a locking system that in a locked position maintains the cover secured to the spray device such that the handle of the spray tip is prevented from rotating or becoming misaligned.

7. The spray device according to claim 6, wherein the locking system includes a projection mateable with a recess.

8. The spray device according to claim 6, wherein the safety lock includes a base, the base having a portion of a shaft extending through an orifice in the base, the shaft having a knob at a first end and a pin at a second end that is mateable with a recess thereby preventing the handle from rotating out of a spraying position.

9. The spray device according to claim 8, wherein a spring is carried on the shaft to bias the pin in the recess when the safety lock is in the locked position.

10. A spray nozzle assembly with a safety lock for a spray device, comprising:

a base connectable to the spray device, the base having an orifice to allow a coating to pass through the base, the base having a bore extending substantially transverse to the orifice;

a spray tip having a shaft located in the base bore and rotatable therein, the spray tip shaft having a bore to allow a coating to pass therethrough when aligned with the base orifice, the spray tip having a handle; and a safety lock having a connector attached to a portion of the spray nozzle assembly, the safety lock having a cover that is engagable with the handle in a locked position that prevents the handle from being rotated such that the shaft bore is out of alignment with the base orifice; and wherein the cover includes at least one side having a longitudinal length extending an entire distance along a longitudinal length of the handle that prevents the handle from being rotated out of alignment with a longitudinal axis of the spray nozzle assembly when the safety lock is in the locked position.

11. The spray nozzle according to claim 10, wherein the safety lock in the locked position includes a top that contacts a top side of the handle and prevents the spray tip shaft bore from being misaligned with the base orifice.

12. The spray nozzle according to claim 11, wherein the safety lock is hingedly connected to the spray nozzle assembly whereby the cover can be moved into the locked position and an unlocked position with respect to the handle.

13. The spray nozzle according to claim 10, wherein the safety lock includes a locking system comprising a projection matable with a recess that secures the safety lock to the base or a spray guard in the locked position.

14. The spray nozzle according to claim 10, wherein the safety lock includes a base, the safety lock base having a portion of a shaft extending through an orifice in the safety lock base, the shaft having a knob at a first end and a pin at a second end that is matable with a recess of the spray nozzle assembly thereby preventing the handle from rotating out of the spraying position.

15. A spray device, comprising:

a rotatable, reversible spray tip, the spray tip having a handle for rotating the spray tip relative to a body of the spray device;

a safety lock operatively connected to a) the body of spray device, b) a safety guard of the spray device, or c) a portion of a spray tip assembly of the spray device, the safety lock having a cover substantially conforming to the shape of the handle such that the cover is selectively engagable with the handle to prevent the handle from rotating out of a spraying position; and wherein the safety lock has a base that is connected to the safety guard by a hinge connector, gluing or welding.

16. The spray device according to claim 15, wherein the safety lock is provided with a locking system that in a locked position maintains the cover secured to the spray device such that the handle of the spray tip is prevented from rotating or becoming misaligned.

17. The spray device according to claim 16, wherein the locking system includes a projection mateable with a recess.

18. The spray device according to claim 16, wherein the safety lock includes a base, the base having a portion of a shaft extending through an orifice in the base, the shaft having a knob at a first end and a pin at a second end that is mateable with a recess thereby preventing the handle from rotating out of a spraying position.

19. The spray device according to claim 18, wherein a spring is carried on the shaft to bias the pin in the recess when the safety lock is in the locked position.

20. The spray device according to claim 1, wherein the cover includes at least one side having a longitudinal length extending a distance along a longitudinal length of the handle that prevents the handle from being rotated out of alignment with a longitudinal axis of the spray tip assembly in the spraying position; and wherein the at least one side extends the entire distance of the longitudinal length of the handle.

* * * * *